US009567781B2

(12) United States Patent
Lim

(10) Patent No.: US 9,567,781 B2
(45) Date of Patent: Feb. 14, 2017

(54) LATCH STRUCTURE OF TAIL GATE

(71) Applicant: HYUNDAI MOTOR COMPANY, Seoul (KR)

(72) Inventor: Yoon-Taek Lim, Incheon (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 0 days.

(21) Appl. No.: 14/872,086

(22) Filed: Sep. 30, 2015

(65) Prior Publication Data

US 2016/0090131 A1 Mar. 31, 2016

(30) Foreign Application Priority Data

Sep. 30, 2014 (KR) ..... 10-2014-0130719

(51) Int. Cl.
*E05C 5/04* (2006.01)
*E05C 3/12* (2006.01)
*E05C 5/02* (2006.01)

(52) U.S. Cl.
CPC .. *E05C 3/12* (2013.01); *E05C 5/02* (2013.01)

(58) Field of Classification Search
CPC ..... E05B 81/06; E05B 81/20; E05B 85/243
USPC ..... 292/201, 216, DIG. 23
See application file for complete search history.

(56) References Cited

U.S. PATENT DOCUMENTS 6,789,825 B2 * 9/2004 Kalargeros ..... E05B 85/26 292/201
8,764,075 B2 * 7/2014 Taurasi ..... E05B 81/14 292/201
8,876,176 B2 * 11/2014 Spurr ..... E05B 81/14 292/201
8,894,107 B2 * 11/2014 Kamata ..... B60N 2/01583 292/194
9,039,048 B2 * 5/2015 Muller ..... B60N 2/01583 292/216
2004/0201226 A1 * 10/2004 Spurr ..... E05B 81/14 292/201
2005/0087994 A1 * 4/2005 Umino ..... E05B 77/54 292/216

(Continued)

FOREIGN PATENT DOCUMENTS

JP 7-109860 A 4/1995
JP 11-6345 A 1/1999

(Continued)

*Primary Examiner* — Matthew Ing
(74) *Attorney, Agent, or Firm* — McDermott Will & Emery LLP

(57) ABSTRACT

A latch structure for a tail gate comprises a housing having an opening groove; a catch having a locking groove disposed in the housing; a pole rotatably mounted on the housing that restricts the rotation of the catch when a protruding portion thereof enters the locking groove; a rail fixed to the housing and having a sliding groove; a link arm having a first end rotatably coupled to the catch, and a second end mounted to be movable along the sliding groove based on the rotation of the catch; a striker; and a stopper disposed in the sliding groove, wherein when the catch is an open position, the striker is configured to enter and exit the locking groove, when the catch is in a locked position, the striker is restricted from entering and exiting the locking groove, and the stopper restricts the movement of the link arm to prevent the catch from rotating.

5 Claims, 5 Drawing Sheets

(56) References Cited

U.S. PATENT DOCUMENTS

| | | | | |
|---|---|---|---|---|
| 2005/0121922 | A1* | 6/2005 | Cetnar | E05B 81/20 292/216 |
| 2005/0212303 | A1* | 9/2005 | Brose | E05B 85/26 292/216 |
| 2005/0253401 | A1* | 11/2005 | Han | E05B 85/045 292/216 |
| 2014/0217752 | A1* | 8/2014 | Lujan | E05B 77/38 292/216 |
| 2015/0308156 | A1* | 10/2015 | Hunt | E05B 79/20 292/201 |

FOREIGN PATENT DOCUMENTS

| | | | |
|---|---|---|---|
| JP | 2001-020579 | A | 1/2001 |
| JP | 2001-98820 | A | 4/2001 |
| JP | 2010-031503 | A | 2/2010 |
| KR | 10-2002-0034384 | A | 5/2002 |
| KR | 10-0836333 | B1 | 6/2008 |
| KR | 10-2010-0008098 | A | 1/2010 |
| KR | 10-1395929 | B1 | 5/2014 |

* cited by examiner

LATCH STRUCTURE OF TAIL GATE

CROSS-REFERENCE TO RELATED APPLICATIONS

This application claims priority under 35 U.S.C. §119 to Korean Patent Application No. 10-2014-130719, filed on Sep. 30, 2014, in the Korean Intellectual Property Office, the entirety of which is incorporated herein by reference.

TECHNICAL FIELD

The present disclosure relates to a latch structure for a tail gate, and more particularly, to a latch structure for a tail gate or a trunk lid, in which a rail and a link arm are coupled in order to solve problems in that a catch cannot be rotated to an unlocked state due to a weight of the tail gate when the catch is rotated from a half locked state to the unlocked state, or the catch returns to the half locked state while being reversely rotated after reaching the unlocked state.

BACKGROUND

A sedan-type passenger vehicle typically includes a trunk disposed at the rear of the vehicle in order to accommodate articles, and isolated from a space in which occupants are located, and the trunk is typically configured to be opened and closed by opening a trunk lid.

An SUV, an MPV, or the like, in which a space for accommodating articles and a space for accommodating the occupants are not separated from each other, has an opening formed at the rear of the interior of a vehicle body so as to easily accommodate articles, and a tail gate is mounted to open and close the opening that is an entrance for an accommodating space.

That is, there is a difference in size and shape between the trunk lid and the tail gate, but the trunk lid and the tail gate serve as a door, which is rotatably mounted to the vehicle body and opens and closes the accommodating space in the vehicle, and commonly have a locking device so as to be prevented from being opened when the vehicle travels or when the vehicle is parked.

The locking device includes a striker which has a loop shape and is fixedly mounted to the vehicle body, and a latch which is mounted at an end of the tail gate or the trunk lid, and coupled to the striker so as to maintain a locked state when the tail gate or the trunk lid is closed.

Referring to FIG. 1, the latch has a structure in which a catch 2 is rotatably mounted to a housing 1 having an opening groove 1A that is formed so that a striker may enter the opening groove 1A. The catch 2 maintains an open position, at which the striker may enter the locking groove 2A, by a spring, and after the striker enters the opening groove 1A, the catch 2 rotates to a locking position at which the striker is restricted from exiting. Further, when the catch 2 rotates to the locked position, a pole 3 having a protruding portion is fitted into the locking groove 2A, thereby restricting the rotation of the catch 2.

The prior art discloses a cinching latch structure for a tail gate, which provides a half locked state that closes the tail gate that is not locked. In the cinching latch structure, in order to implement two locked states, a fully locked state and a half locked state, a catch 2 has a structure in which a second locking groove 2B into which a pole 3 is fitted in the half locked state is additionally formed in addition to a locking groove 2A into which the pole 3 is fitted in the fully locked state.

However, in the cinching latch structure, there is a problem in that the unlocked state may be inadvertently changed to the half locked state due to the weight of the tail gate, which may cause a user to sense that the tail gate is caught when the tail gate is opened and closed.

That is, when the pole 3 is rotated by an operation of a motor in the fully locked state in which the striker is completely fastened, the catch 2, which has been fixed by the pole 3, is rotated to the unlocked state by elastic force of the spring while passing through the half locked state (for reference, the catch is in the half locked state when the catch rotates 30 degrees, and the catch is in the unlocked state when the catch rotates 60 degrees).

However, there may be a problem in that when the half locked state is changed into the unlocked state, the catch sags due to a weight of the tail gate (as the catch is pressed by the striker), and then returns to the half locked state, and this problem causes the user to sense that the tail gate is caught and/or sense heterogeneity when the tail gate is opened.

SUMMARY

The present disclosure has been made in an effort to provide a latch structure of a tail gate, which may solve the aforementioned problem by preventing inadvertent rotation of a catch when a half locked state is changed into an unlocked state.

An exemplary embodiment of the present inventive concept provides a latch structure for a tail gate comprising a housing having an opening groove; a catch having a locking groove disposed in the housing; a pole rotatably mounted on the housing that restricts the rotation of the catch when a protruding portion of the pole enters the locking groove; a rail fixed to the housing and having a sliding groove; a link arm having a first end rotatably coupled to the catch, and a second end mounted to be movable along the sliding groove based on the rotation of the catch; a striker; and a stopper disposed in the sliding groove, wherein when the catch is an open position, the striker is configured to enter and exit the locking groove, when the catch is in a locked position, the striker is restricted from entering and exiting the locking groove, and the stopper restricts the movement of the link arm to prevent the catch from rotating.

The stopper may be a projection convexly protruding from a surface of the sliding groove.

The latch structure may comprise at least two stoppers, wherein the at least two stoppers are disposed such that an end of the link arm may fit between adjacent stoppers.

The latch structure may further comprise a catch pin including a mounting unit having a plate shape and a first surface fixed to the housing, and a shaft protruding from a second surface of the mounting unit, wherein the catch is coupled to the shaft of the catch pin and rotates, and the rail is coupled to the mounting unit.

The sliding groove may have an arc shape, and the link arm may be mounted so that the first end moves a longer distance in a width direction of the sliding groove than the second end moves in the width direction of the sliding groove.

Meanwhile, the present inventive concept is not limited to the latch structure of the tail gate, and may also be applied to a latch of a trunk lid which performs the same function as the latch structure of the tail gate and has a structure coupled to a striker so as to open and close an accommodating space in a vehicle. That is, in the specification of the present inventive concept, the tail gate may include a trunk lid for a sedan type vehicle as well as a tail gate of an SUV or an MPV.

The present inventive concept, which has the aforementioned configurations, may solve the problem in that the unlocked state of the tail gate is changed into the half locked state by a weight of the tail gate.

The rail and the link arm of the present inventive concept may be mounted to the catch in the related art, such that the latch structure may be manufactured without greatly increasing production costs. Further, (unlike other structures that have similar objects to the present inventive concept, but control rotation of the pole), since rotation of the catch is directly restricted instead of the pole, additional logic, sensors, and electronic components are not required.

DETAILED DESCRIPTION

Figure 1:
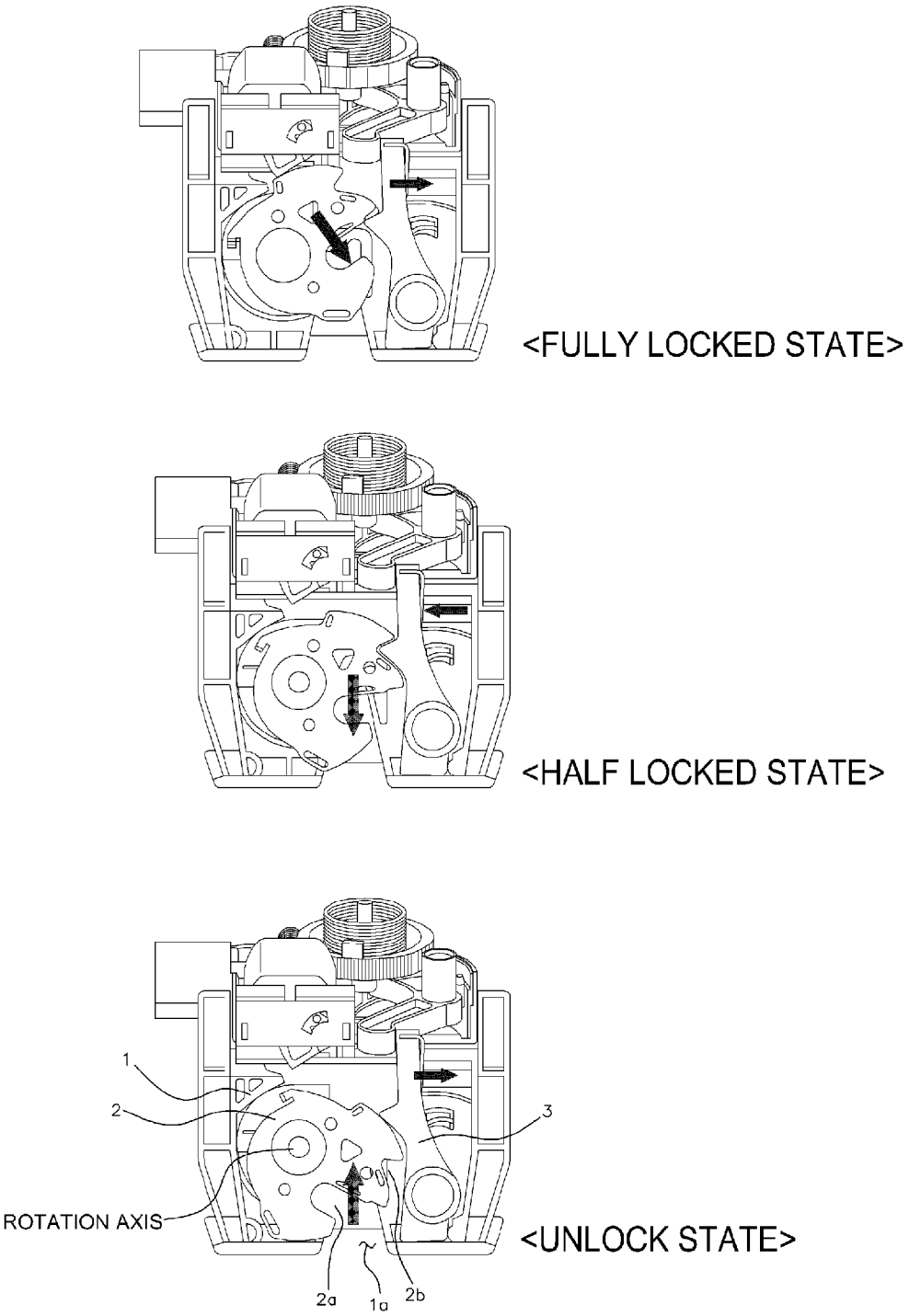
FIG. 1 is a view illustrating appearances in which a latch of a tail gate in the related art is in a fully locked state, in a half locked state, and in an unlocked state.
Figure 2:
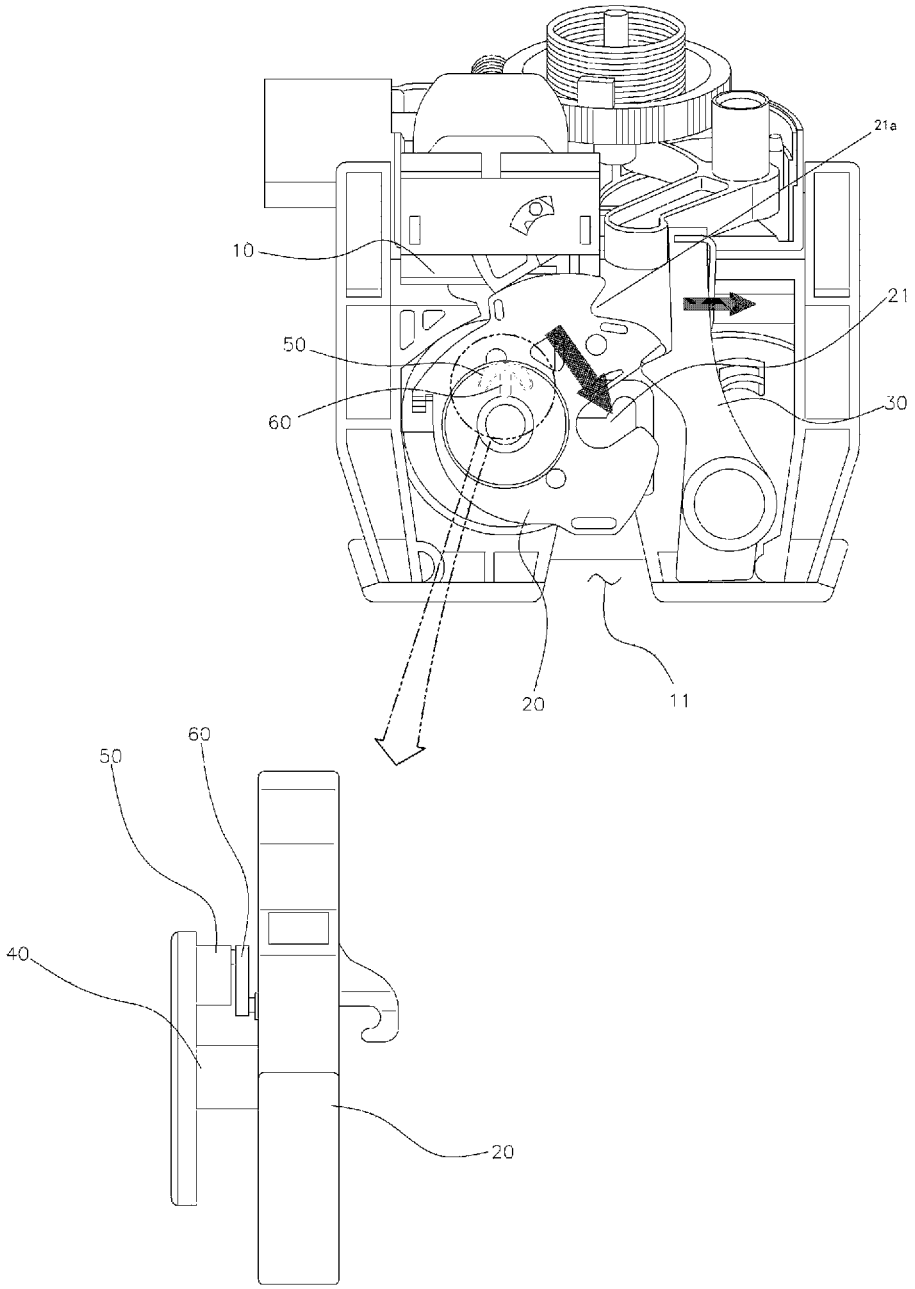
FIG. 2 is a view illustrating a front appearance of a latch of a tail gate according to an exemplary embodiment of the present inventive concept, and a side appearance in which a catch pin, a rail, a link arm, and a catch are coupled.
Figure 3:
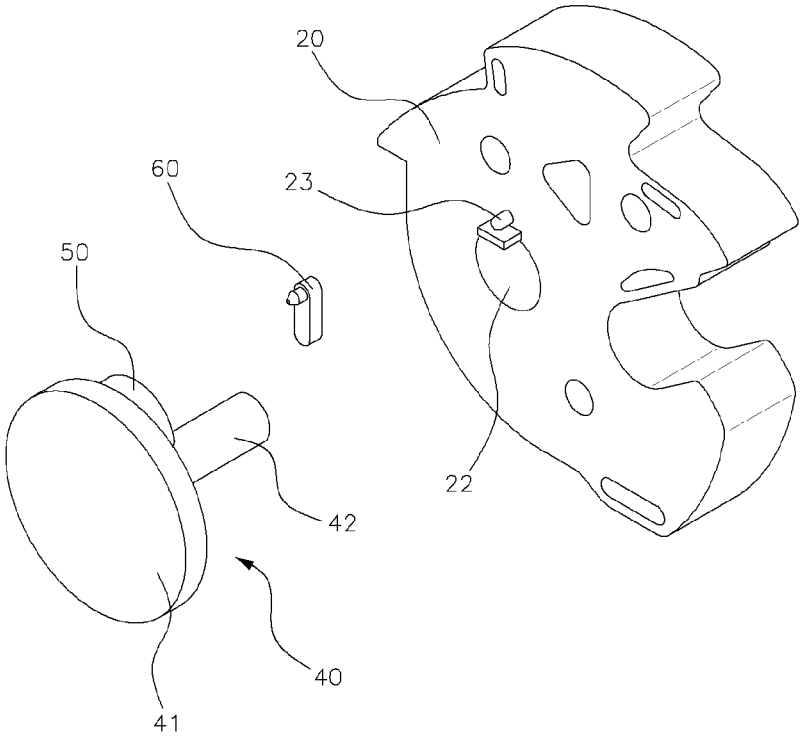
FIG. 3 is a view illustrating an appearance in which the catch pin, the link arm, and the catch are separated.
Figure 4:
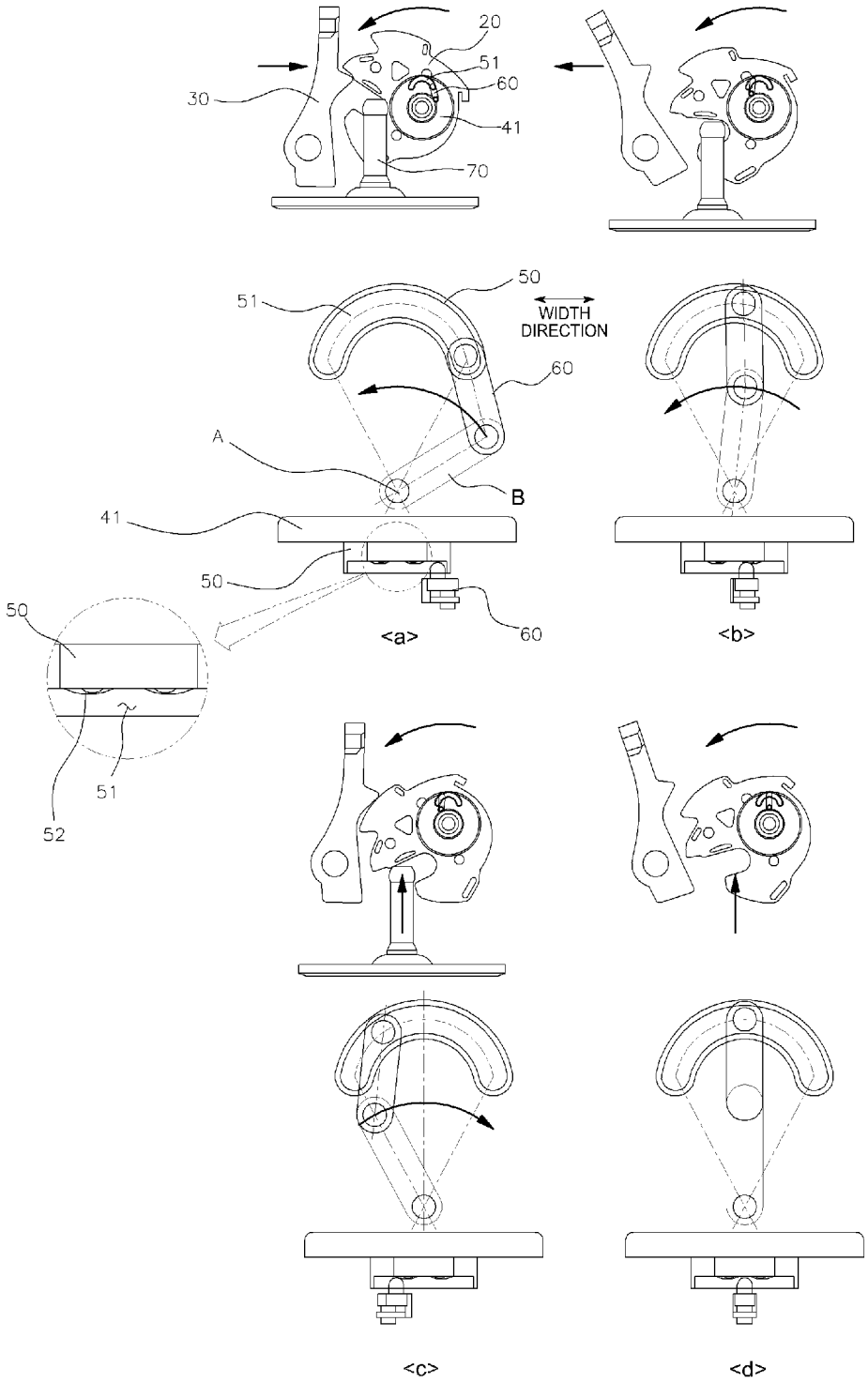
FIG. 4 is a view sequentially illustrating appearances in which the catch is rotated when the tail gate is opened, and appearances in which the link arm moves according to the rotation of the catch (however, in order to prevent lines from overlapping between projections and the link arm, the projections are omitted from the front appearance of a sliding groove).

As shown in FIGS. 2-4, a latch of a tail gate according to the present inventive concept includes a catch 20 which is rotatably coupled to a housing 10, and a pole which restricts the rotation of the catch 20, and further includes a rail 50, and a link arm 60, and in order to prevent the catch 20 from being rotated due to the entry of a striker 70 while the catch 20 is rotated from a locked position (a fully locked state or a half locked state) to an open position (a unlocked state), a stopper, which may restrict movement of the link arm 60, is formed at a sliding groove 51 formed in the rail 50.

Hereinafter, a latch structure for a tail gate according to an exemplary embodiment of the present inventive concept will be described in more detail with reference to the drawings.

Referring to FIGS. 2 and 3, an opening groove 11 is formed at a lower end of the housing 10 so that the striker 70 may enter the opening groove 11 when the tail gate is closed. The catch 20 has a locking groove 21 and a second locking groove 21A which are formed so that the pole 30 may be fitted into the locking groove 21 and the second locking groove 21A. The catch 20 is mounted to the housing 10 by means of a catch pin 40 so that the catch 20 maintains the open position, at which the striker 70 may enter the locking groove 21, by a spring (not illustrated) (that is, elastic force of the spring is applied to maintain the opening state), and the catch 20 is rotated to the locked position at which the striker 70 is restricted after the striker 70 enters the opening groove 11.

The catch pin 40 includes a mounting unit 41 having a plate shape with one surface fixed to the housing 10, and a shaft 42 which protrudes from the other surface of the mounting unit 41. The catch 20 has a hole 22 into which the shaft 42 is inserted, such that the catch 20 may be rotated about an axis. Further, the rail 50 is coupled to the mounting unit 41, and the sliding groove 51 is formed in a surface of the rail 50 which faces the catch 20.

The link arm 60, which has one end that is rotatably coupled to the catch 20 by means of a ball joint 23 and has the other end that is movably connected in the sliding groove 51 by means of a ball joint having a similar structure to the ball joint 23, is coupled between the mounting unit 41 and the catch 20.

Figure 5:
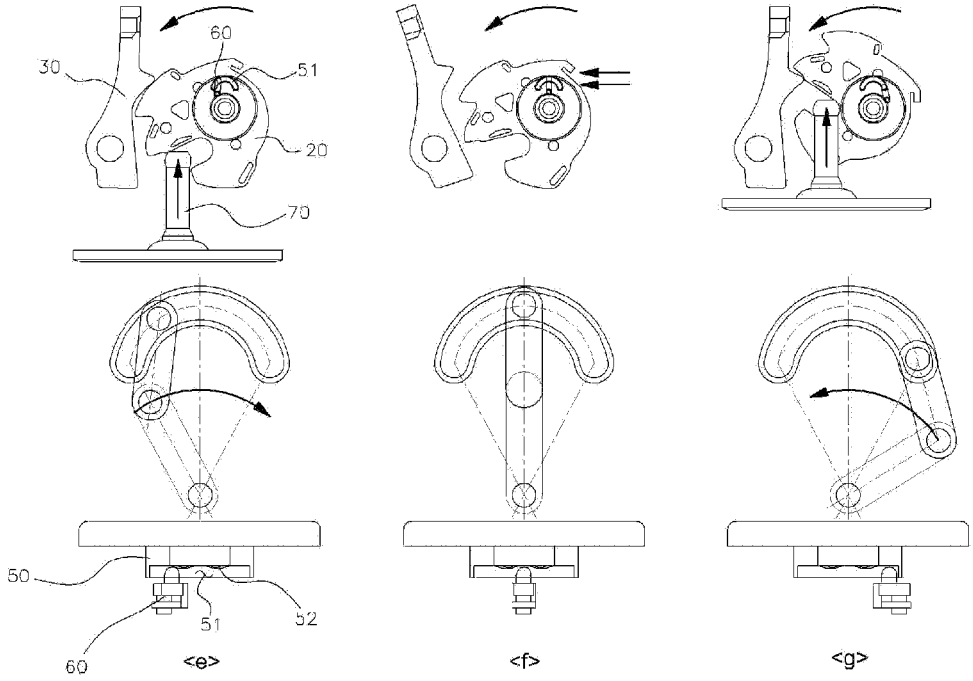
FIG. 5 is a view sequentially illustrating appearances in which the catch is rotated when the tail gate is closed, and appearances in which the link arm moves according to the rotation of the catch (however, in order to prevent lines from overlapping between the projections and the link arm, the projections are omitted from the front appearance of the sliding groove).

That is, as the catch 20 rotates, the link arm 60 is rotated about the ball joint 23 coupled to the catch 20, and slides in the sliding groove 51, as illustrated in FIGS. 4 and 5. In this case, a shape of a trajectory of the link arm 60 is determined based on a distance B between a point A at which the shaft 42, which is used as a rotation axis of the catch 20, is fitted and a point at which the ball joint 23 is mounted.

Thus, in the exemplary embodiment of the present inventive concept, the sliding groove 51 is formed in an arc shape, which has a predetermined curvature, in consideration of 'the distance B between the rotation axis of the link arm and the rotation axis of the catch', and a length of the link arm 60. Further, the link arm 60 is mounted so that one end of the link arm 60, which is coupled to the catch 20, may move a longer distance in a width direction of the sliding groove 50 than the other end of the link arm 60 which moves along the sliding groove 51.

Meanwhile, a projection 52, which convexly protrudes to serve as a stopper that may restrict the movement of the link arm 60, is formed on a surface of the sliding groove 51. In an exemplary embodiment of the present inventive concept, two or more projections 52 are formed, and the projections 52 are disposed to be spaced apart from each other so that the end of the link arm 60 may be restricted between the adjacent projections 52.

In the structure of the present inventive concept which is configured as described above, like the structure in the related art, a fully locked state is changed into a half locked state when the catch 20 rotates 30 degrees base on the fully locked state, and the fully locked state is changed into an unlocked state when the catch 20 rotates 60 degrees. Further, when the catch 20 is positioned at an angle between 30 degrees and 60 degrees (preferably, approximately 40 degrees), the link arm 60 is positioned between the projections 52, thereby supporting a weight of the tail gate, and preventing an inadvertent change into the half locked state.

When describing a state when the tail gate is opened with reference to FIG. 4, an <A> state indicates a state in which the catch 20 is in the fully locked state. Elastic force is applied in a counterclockwise direction so that the catch 20 may be rotated to the unlocked state by elastic force of the spring, but the rotation of the catch 20 is restricted by the pole 30. In this case, the link arm 60 is positioned at the relatively right side.

When a motor is operated by a manipulation of a user and then the pole 30 is rotated, the catch 20 passes through a <B> state, which defines an angle where it is in the half locked state, and then reaches a <C> state, such that the catch 20 is in the unlocked state. As the catch rotates, the link arm 60 also passes over the projections 52 and moves to the left side of the sliding groove 51. When the operation of the motor is stopped, the pole 30 is in close contact with the catch 20 in the unlocked state by elastic force of the spring (coupled to the pole), thereby maintaining the unlocked state.

Here, in the case of the structure in the related art in which 'force caused by a weight of the tail gate' may be greater than 'elastic force of the spring coupled to the catch 20', there may be a problem in that the catch 20 is inadvertently rotated, and the unlocked state is changed into the half locked state. However, as shown in the <D> state, the present inventive concept provides a structure in which the link arm 60 may be supported between the projections 52, that is, a structure in which 'force by which the link arm is supported between the projections' is added to 'the elastic force of the spring coupled to the catch', thereby sufficiently supporting force caused by a weight of the tail gate.

Meanwhile, as illustrated in FIG. 5, when the tail gate is closed, the resultant force of 'inertial force applied to the tail gate' and 'force by which the striker 70 enters to rotate the catch' is even greater than the resultant force of 'force by which the link arm is supported between the projections' and 'elastic force of the spring coupled to the catch', such that the link arm 60 is not restricted by the projections 52, and whereby the catch 20 may rotate in the sequence of <E>, <F>, and <G> states and then reach the fully locked state.

As described above, the present inventive concept may prevent a phenomenon in which the tail gate cannot be opened because of the weight of the tail gate (an inadvertent change into the half locked state), and has a simple structure that may easily be applied to the structure in the related art.

As the foregoing, the exemplary embodiments of the present inventive concept disclosed in the present specification and the drawings merely suggest specific examples for better understanding of the present inventive concept, but are not intended to limit the scope of the present inventive concept. It is obvious to those skilled in the technical field to which the present inventive concept pertains that in addition to the exemplary embodiments disclosed herein, various modifications may be implemented based on the technical spirit of the present inventive concept.

What is claimed is:

1. A latch structure for a tail gate comprising:

a housing having an opening groove;

a catch having a locking groove disposed in the housing;

a pole rotatably mounted on the housing that restricts the rotation of the catch when a protruding portion of the pole enters the locking groove;

a rail fixed to the housing and having a sliding groove;

a link arm having a first end rotatably coupled to the catch, and a second end mounted to be movable along the sliding groove based on the rotation of the catch;

a striker; and a stopper disposed in the sliding groove, wherein when the catch is an open position, the striker is configured to enter and exit the locking groove, when the catch is in a locked position, the striker is restricted from entering and exiting the locking groove, and the stopper restricts the movement of the link arm to prevent the catch from rotating.

2. The latch structure of claim 1, wherein the stopper is a projection convexly protruding from a surface of the sliding groove.

3. The latch structure of claim 2, comprising at least two stoppers, wherein the at least two stoppers are disposed such that an end of the link arm may fit between adjacent stoppers.

4. The latch structure of claim 1, further comprising:

a catch pin including a mounting unit having a plate shape and a first surface fixed to the housing, and a shaft protruding from a second surface of the mounting unit, wherein the catch is coupled to the shaft of the catch pin and rotates, and the rail is coupled to the mounting unit.

5. The latch structure of claim 4, wherein the sliding groove has an arc shape, and the link arm is mounted so that the first end moves a longer distance in a width direction of the sliding groove than the second end moves in the width direction of the sliding groove.

* * * * *